US009126212B2

(12) United States Patent
Pirshafiey

(10) Patent No.: US 9,126,212 B2
(45) Date of Patent: Sep. 8, 2015

(54) ADJUSTABLE DIALED SPRAY NOZZLE

(71) Applicant: Nasser C. Pirshafiey, Thousand Oaks, CA (US)

(72) Inventor: Nasser C. Pirshafiey, Thousand Oaks, CA (US)

(73) Assignee: Global Aerosol LLC, Costa Mesa, CA (US)

( * ) Notice: Subject to any disclaimer, the term of this patent is extended or adjusted under 35 U.S.C. 154(b) by 49 days.

(21) Appl. No.: 13/899,272

(22) Filed: May 21, 2013

(65) Prior Publication Data

US 2014/0346246 A1 Nov. 27, 2014

(51) Int. Cl.

| | |
|---|---|
| ***B05B 1/12*** | (2006.01) |
| ***B05B 1/30*** | (2006.01) |
| ***B65D 83/44*** | (2006.01) |
| ***B65D 83/52*** | (2006.01) |

(52) U.S. Cl.

CPC . *B05B 1/12* (2013.01); *B65D 83/44* (2013.01); *B05B 1/30* (2013.01); *B65D 83/52* (2013.01)

(58) Field of Classification Search

CPC ..... B05B 1/12; B05B 1/30; B05B 1/3026; B65D 83/16; B65D 83/20; B65D 83/207; B65D 83/24; B65D 83/30; B65D 83/44; B65D 83/52; B65D 83/525; B65D 83/54; B65D 83/543; B65D 83/546

See application file for complete search history.

(56) References Cited

U.S. PATENT DOCUMENTS

| | | | | |
|---|---|---|---|---|
| 3,176,888 | A * | 4/1965 | Focht | 222/402.17 |
| 3,638,867 | A * | 2/1972 | Venus, Jr. | 239/573 |
| 3,863,816 | A * | 2/1975 | Focht | 222/402.17 |
| 3,961,756 | A * | 6/1976 | Martini | 239/337 |
| 5,261,574 | A * | 11/1993 | Jouillat et al. | 222/402.1 |
| 2007/0125879 | A1 * | 6/2007 | Khamenian | 239/337 |
| 2007/0272765 | A1 * | 11/2007 | Kwasny | 239/337 |

* cited by examiner

*Primary Examiner* — Darren W Gorman

(74) *Attorney, Agent, or Firm* — Marcus C. Dawes; Daniel L. Dawes

(57) ABSTRACT

A spray nozzle configured to be disposed on top of and coupled to a standard spray paint canister. Compressed gas within the spray paint canister serves as the propellant which expels the liquid paint out of the canister when the nozzle is actuated. The paint and compressed gas travel through the internal passageways of the nozzle and are ejected from the nozzle in a three-dimensional conical discharge. The nozzle comprises an adjustable valve for a user to manipulate and change the emitted three-dimensional discharge from the canister. The adjustable valve alters the internal flow characteristics of the nozzle which in turn change the diameter of a circular spray pattern which is produced when the nozzle is held at a set distance away from a surface that is being sprayed. The user may adjust the fluid flow during use or between uses.

11 Claims, 4 Drawing Sheets

ADJUSTABLE DIALED SPRAY NOZZLE

BACKGROUND

1. Field of the Technology

The disclosure relates to the field of nozzles for aerosol cans, specifically a nozzle with an adjustable level of fluid flow.

2. Description of the Prior Art

Aerosol paint is commonly used for small painting tasks. Various paint types and container sizes are used to meet a variety of needs. The paint is generally contained in a pressurized can, and a simple nozzle resides on a stem extending from the top of the can. The stem is extends from an underlying valve which is activated or opened by pressing downwardly on the stem. The nozzles typically are removable to clean or replace if necessary.

While aerosol paint cans provide ease of use, they are not very versatile. In contrast, common air brushes allow adjustment of a spray pattern, and thus allow for much more detailed or controlled painting. Unfortunately, air brushes also have added cost and require a separate compressed air source. As a result, aerosol cans with nozzles are much more common than air brushes, and adjustable nozzles have been developed for such aerosol cans to overcome some of the deficiencies of non-adjustable nozzles.

Adjustable nozzles for use with common aerosol spray cans are described in U.S. Pat. No. 3,648,932 for "Valve Button With Aspirator Passageway," and U.S. Pat. No. 3,961,756 for "Adjustable-Spray Mechanism." The adjustable nozzles described in the '932 patent and the '756 patent include cylindrical adjusters cooperating with valving portions of fluid passages, thereby allowing adjustment of a fluid flow through the fluid passage. The fluid passages are in fluid cooperation with the stem extending from a spray car and include a vertical portion, and then a horizontal portion including the valving portion. Unfortunately, because the valving portion is not aligned with the vertical portion, the valves are difficult to clean, and therefore clog easily. The nozzles described in the '932 patent and the '756 patent further do not provide means to adjust a spray pattern from the nozzles.

Additional spray nozzles for common use are described in U.S. Pat. No. 1,833,983 for "Valve," and U.S. Pat. No. 3,788,550 for "Automatic Intermittent Spray Valve for Pressurized Packaging." The nozzles described in patents '983 and '550 do comprise a vertical portion that is in line with the valving portion, however neither one would be capable of dispensing textured paint since the needle valves which are disclosed therein do not comprise means for avoiding clogging or providing a regulated fluid flow.

What is needed therefore is an adjustable nozzle that may be fitted on a standard aerosol can which allows for the adjustable application of a fluid flow for a paint.

BRIEF SUMMARY

The invention includes a nozzle having a pathway defined therein for varying the size of a spray pattern for use with an aerosol canister containing a fluid. The nozzle includes a coupling portion of the pathway that communicates with the aerosol canister and an internal pathway that communicates with the coupling portion of the pathway. An orifice also communicates with the internal pathway and a metering valve is in contact with the internal pathway which varies an internal pressure of the fluid within the internal pathway.

In one embodiment, the metering valve of the nozzle is a dial valve disposed at the junction of a lower passage and an upper passage which define the internal pathway. The dial valve itself includes a knob disposed on a proximal end and a groove defined in the surface circumferentially around a distal end. The depth of the groove increases as a function of its relative location around the circumference of the distal end of the dial valve. The groove defined in the dial valve is also in fluidic contact with the lower passage and the upper passage of the internal pathway.

In another embodiment, the distal portion of the dial valve is substantially tapered.

In yet another embodiment, the dial valve has a top and the groove is configured to direct the flow of the fluid within the aerosol canister over the top of the dial valve.

In a related embodiment, the dial valve has a bottom and the groove is configured to direct the flow of the fluid within the aerosol canister under the bottom of the dial valve.

In still another embodiment, the lower passage and the upper passage defining the internal pathway of the nozzle are oriented obliquely with respect to each other.

In another embodiment, the nozzle further includes an orifice passage communicating with the orifice of the nozzle.

The invention also provides a method for varying the size of a spray pattern created by a spray nozzle. The method includes coupling the nozzle to a pressurized canister containing a fluid and then flowing the fluid through a plurality of internal passages defined in the nozzle. The internal pressure within at least one of the plurality of internal passages is varied by a user and the fluid is then discharged from an orifice coupled to the at least one of the plurality of internal passages.

In one embodiment, the method step of varying an internal pressure within at least one of the plurality of internal passages is done by rotating a dial valve disposed at a junction of a lower passage and an upper passage defining the internal passages. The dial valve has a distal end surface and comprises a groove with a continuously varying depth defined circumferentially into the distal end surface of the dial valve, and the groove further includes at least a shallow portion and a deep portion of the groove.

In another embodiment, the dial valve has a top and flowing a fluid through a plurality of internal passages defined in the nozzle includes orientating the groove defined in the dial valve to direct the flow of the fluid over the top of the dial valve.

In a related embodiment, the dial valve has a bottom and flowing a fluid through a plurality of internal passages defined in the nozzle includes orientating the groove defined in the dial valve to direct the flow of the fluid under the bottom of the dial valve.

In another embodiment, rotating the dial valve located at the junction of a lower passage and an upper passage defining the internal pathway is accomplished by rotating a knob disposed on the proximal end of the dial valve.

In yet another embodiment varying the internal pressure within at least one of the internal passages includes increasing the internal pressure within the at least one of the internal passages by rotating the dial valve and exposing the shallow portion of the groove to the flow of fluid. Similarly, varying an internal pressure within at least one of the plurality of internal passages may also include decreasing the internal pressure within the at least one of the internal passages by rotating the dial valve and exposing the deep portion of the groove to the flow of fluid.

In another embodiment, the method further includes communicating a detachable orifice passage with the orifice.

Finally, the method also includes closing the flow of fluid through the internal passages defined within the nozzle.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

An exemplary embodiment of the current invention is an adjustable dialed spray nozzle 10 seen in FIGS. 1-6. The spray nozzle 10 is configured to be disposed on top of and coupled to a standard spray paint canister. A standard spray paint canister is any vessel containing pressurized liquid paint mixed with a compressed gas. The compressed gas serves as the propellant which expels the liquid paint out of the canister when the nozzle 10 is actuated. The paint and compressed gas travel through the internal passageways of the nozzle 10 and are ejected from the nozzle 10 in a three-dimensional conical discharge. The nozzle 10 comprises means for a user to adjust and change the emitted three-dimensional discharge which in turn changes the diameter of a circular spray pattern which is produced when the nozzle 10 is held at a set distance away from a surface that is being sprayed. The nozzle 10 and its components are preferably comprised of durable plastic or plastic composites; however other suitable materials now known or later devised may also be used without significantly departing from the scope of the invention.

Figure 1:
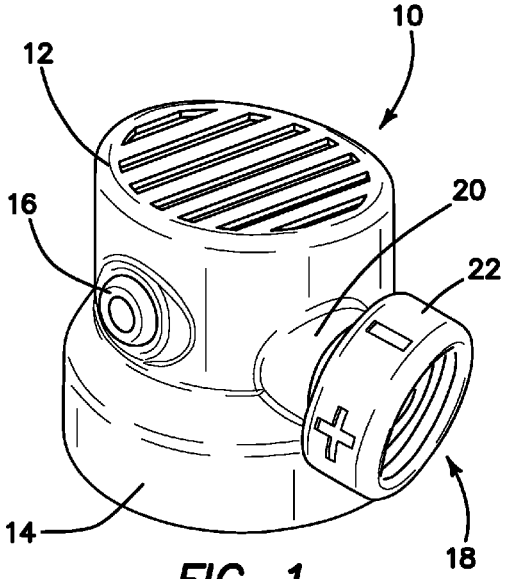
FIG. 1 is a perspective view of the nozzle and shows the knob of the dial valve extending from the nozzle body.

Turning to FIG. 1, the nozzle 10 comprises an upper housing 12 and a lower housing 14. The lower housing 14 comprises a larger diameter than that of the upper housing 12. Disposed in the upper housing 12 is an orifice 16 which emits the liquid paint and compressed gas as a spray. Also disposed in the upper housing 12 is a dial valve 18 which is coupled to the spray nozzle 10 via a shaped nozzle arm 20.

Figure 3:
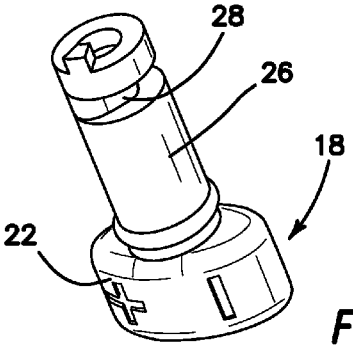
FIG. 3 is a perspective view of one embodiment of the dial valve disposed in the nozzle seen in FIG. 1.

Greater understanding of the dial valve 18 may be had by turning to FIG. 3. The dial valve 18 is substantially "key" shaped. Specifically, the dial valve 18 comprises a body 26 with a knob 22 disposed on its proximal end, and a groove 28 with a sloped or varied depth at its distal end. The knob 22 is substantially oval shaped which allows a user to easily grip and manipulate it as needed. By rotating the knob 22, the body 26 and the groove 28 of the dial valve 18 are likewise rotated by a corresponding amount.

The groove 28 has a varied depth that is defined within the body 26 of the dial valve 18. Specifically, in one particular embodiment, the depth of the groove 28 begins flush with the surface of the body 26 and then gradually deepens as the groove 28 traverses the circumference of the body 26. The beginning of the groove 28 has a minimum depth which defines it as a "shallow" portion while the end of the groove 28 has a maximum depth, making it a "deep" portion. In other words, the groove 28 provides a varied recessed surface which is defined in the body 26 of the dial valve 18, the depth of said groove 28 being dependent upon its location with respect to its location around the circumference of the body 26.

Figure 7:
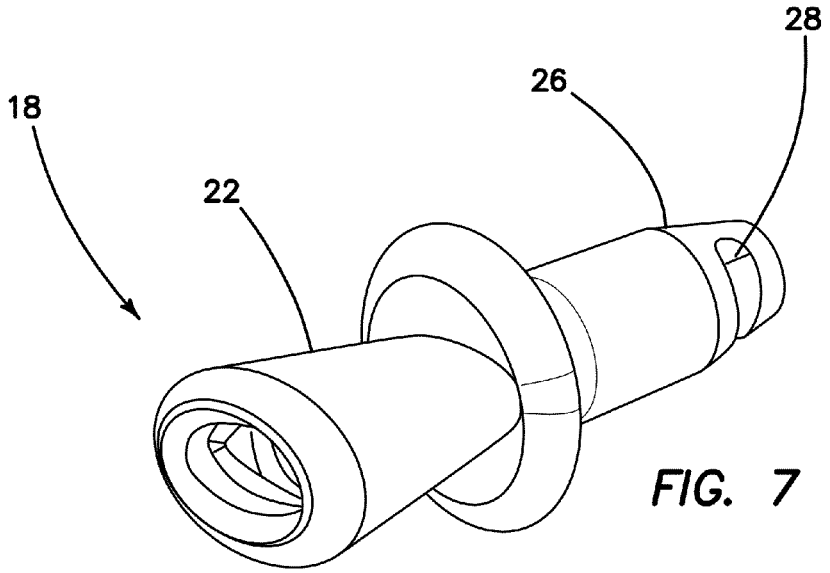
FIG. 7 is a perspective view of an alternative embodiment of the dial valve seen in FIG. 3.

An alternative embodiment of the dial valve 18 may be seen in FIG. 7. Here, the valve body 26 comprises a distal end which is substantially tapered, thus providing additional surface area for turbulent fluid flow around the valve 18 including through the groove 28.

Figure 2:
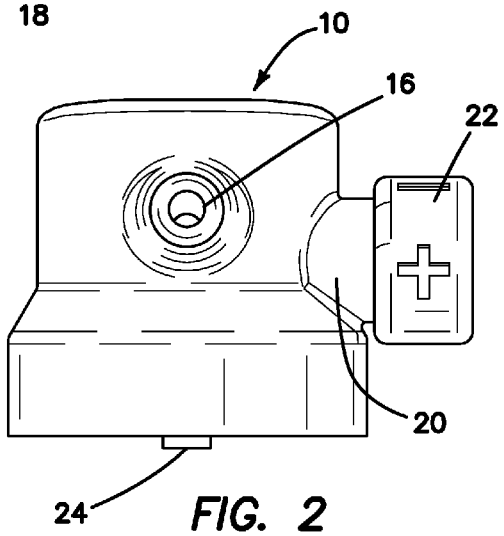
FIG. 2 is a frontal view of the nozzle seen in FIG. 1.
Figure 6:
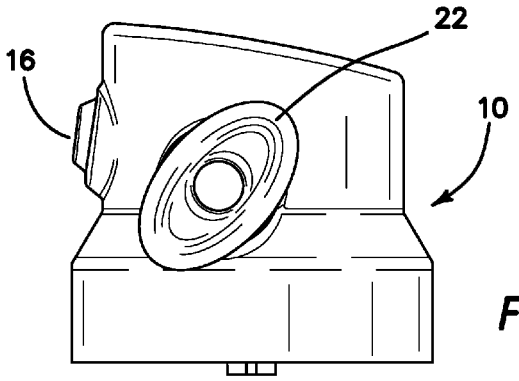
FIG. 6 is a side view of the nozzle seen in FIG. 1.

The dial valve 18 when fully inserted into the nozzle arm 20 leaves the knob 22 exposed outside the upper housing 12 as best seen FIGS. 1, 2, and 6. As also seen in FIG. 2, the nozzle 10 comprises coupling portion 24 of a lower passage 30 which protrudes beneath the lower housing 14. The coupling portion 24 couples to a stem valve or other entry means common to most pressurized spray canisters.

Figure 4:
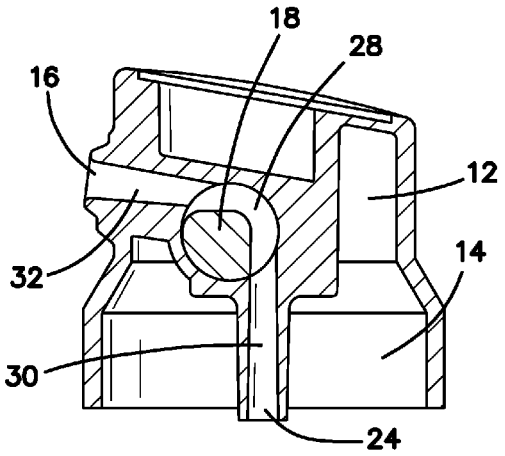
FIG. 4 is a cross sectional view taken through 4-4 seen in FIG. 5 with the flow of fluid passing over the top of the dial valve.
Figure 5:
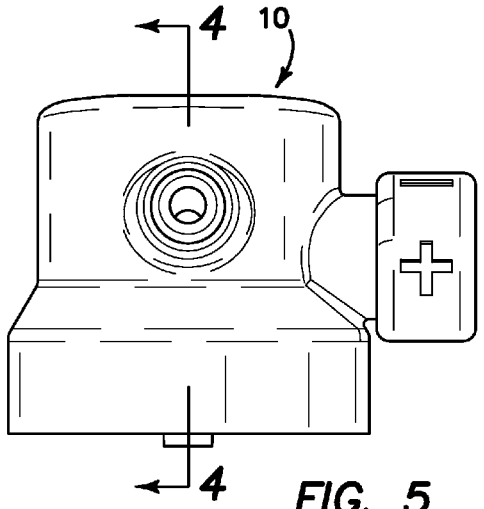
FIG. 5 is a frontal view of the nozzle seen in FIG. 1.

The internal fluid pathways of the nozzle 10 may be seen in the cross sectional view of FIG. 4. In one specific embodiment, the internal pathways comprise a lower passage 30 and an upper passage 32. The lower passage 30 and upper passage 32 are fluidicly coupled to one another to a varied degree according to the orientation of the groove 28 of the dial valve 18 with respect the rest of the nozzle 10. In this embodiment, the dial valve 18 is orientated between the lower passage 30 and the upper passage 32 so that the flow of fluid passes over the dial valve 18. For example, in FIG. 4, the dial valve 18 is orientated in a substantially "open" position, specifically the dial valve 18 has been manipulated so that the groove 28 has maximized the internal volume of the pathways of the nozzle 10. In this orientation, because the internal volume is high, the pressure of the fluid traveling through the groove 28 and the upper passage 32 is low, resulting in particles exiting the nozzle 10 through the orifice 16 at a relatively slow velocity. Slower velocities allow the outside air molecules to deflect and spread the spray pattern to a wider cone, hence creating a larger two-dimensional circular pattern on the surface in which the paint is being applied to. It is important to note that while the lower passage 30 is seen in FIG. 4 as being substantially vertical, and upper passage 32 as slightly inclined with respect to the horizontal, other orientations of the passages 30, 32 other than what is explicitly seen may also be possible, if not even preferable.

When the nozzle 10 is coupled to a pressurized canister, liquid paint and propellent travel up through the coupling portion 24 of the lower passage 30 and makes contact with the groove 18. Because the groove 18 comprises different dimensions than the lower passage 30, the paint and gas mixture will speed up or slow down accordingly as it enters the upper passage 32. The paint and gas mixture than exits the nozzle 10 through the orifice 16 as a substantially conically shaped discharge. When the user rotates the knob 22 of the dial valve 18, the internal geometry and volume of the inner pathways of the nozzle 10 change. Specifically the varied depth of the groove 28 changes the volume of the pathway which increases or decreases the pressure of the liquid paint and compressed gas flowing through it, depending on which direction the knob 22 is rotated. By varying the internal pressure of the pathway, the velocity of the paint and gas mixture of particles emitted through the orifice 16 is affected accordingly. The velocity of the particles in turn determines the inertia that carries the particles through the ambient air surrounding the canister as they are discharged from the nozzle 10. For example, by actuating the knob 22 and making a smaller internal volume of the pathway by rotating the groove 28 to provide a shallower depth to the pathway, the pressure of the flowing fluid increases, leading to a higher particle velocity from the nozzle 10. Particles discharged with a higher velocity will produce a tighter particle pattern when they encounter the ambient air density, thus creating a smaller circular spray pattern on the surface being painted. By rotating the knob 22 in the opposing direction, the groove 28 of the dial valve 18 becomes deeper, increasing the volume of the pathway and thus slowing the outgoing velocity of the particle mixture. The resulting slower velocity discharge allows the particles to spread wider in the ambient atmosphere, increasing the diameter of the circular spray pattern created on the surface to be painted. The user may freely rotate the knob 22 until a desired spray pattern is achieved, including during mid-application of the paint and gas mixture.

Figure 8A:
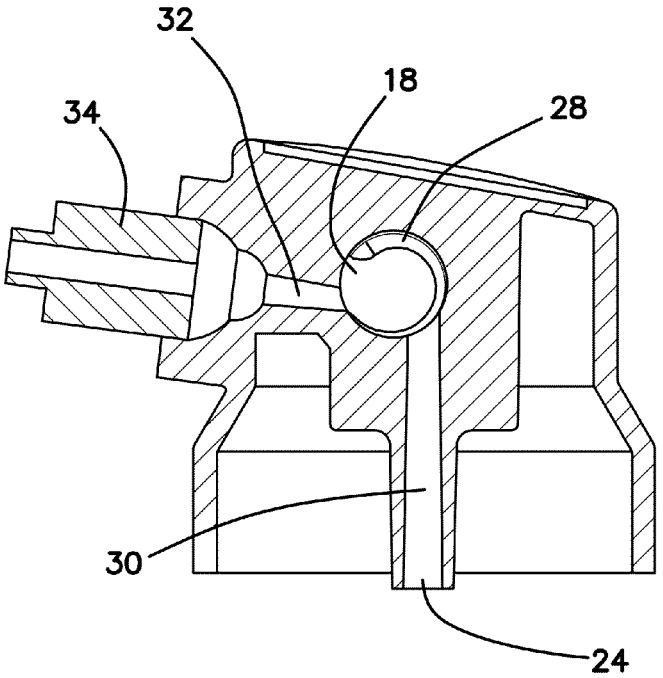
FIG. 8A is a cross sectional view of an alternative embodiment of the nozzle with the flow of fluid passing under the bottom of the dial valve and where the dial valve is in the closed position.
Figure 8B:
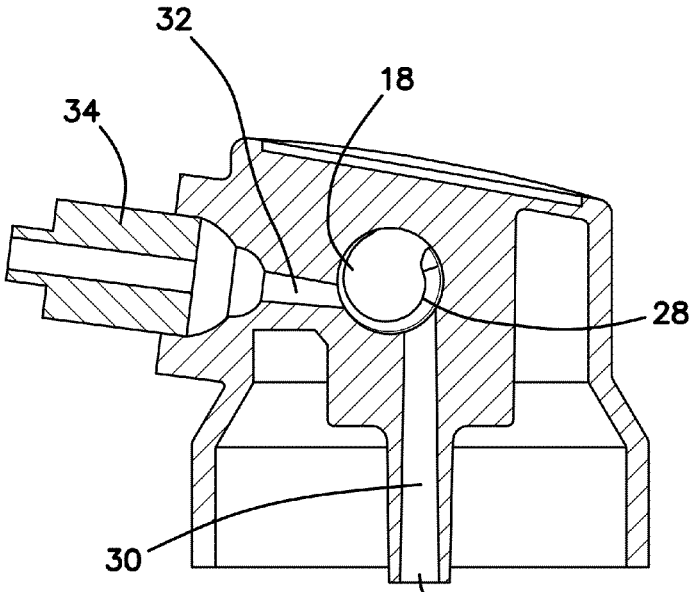
FIG. 8B is a cross sectional view of an alternative embodiment of the nozzle with the flow of fluid passing under the bottom of the dial valve and where the dial valve is in a partially opened position.
Figure 8C:
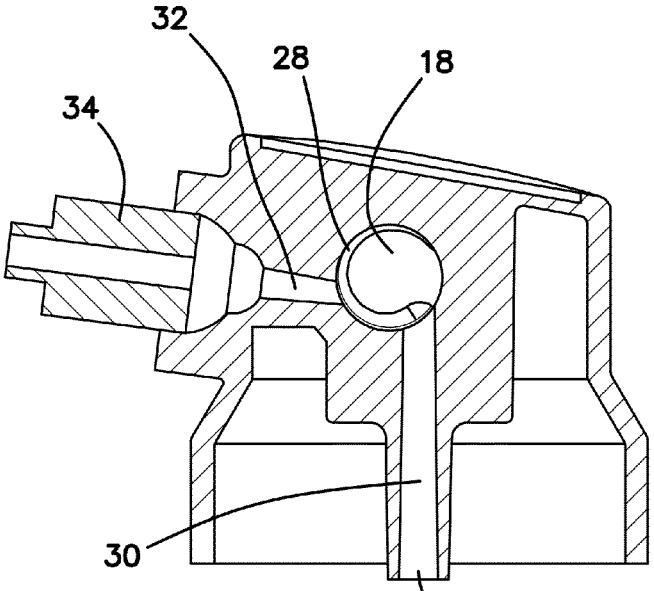
FIG. 8C is a cross sectional view of an alternative embodiment of the nozzle with the flow of fluid passing under the bottom of the dial valve and where the dial valve is in the fully open position.

In a related embodiment shown in FIGS. 8A-8C, an alternative configuration of the internal passages for the nozzle 10 is shown. In this embodiment, the dial valve 18 is orientated between the lower passage 30 and the upper passage 32 so that the groove 28 controls the flow of fluid which passes beneath the dial valve 18. For example, as seen in FIG. 8A, the dial valve 18 is shown in a substantially "closed" position with the groove 28 not making contact with the upper passage 32 at all. As seen here, the dial valve 28 blocks the flow of all fluid and prevents any fluid from entering the upper passage 32. FIG. 8B shows the dial valve in a partially open position with the groove 28 defined therein allowing partial passage of fluid between the lower passage 30 and the upper passage 32. Note that because the groove 28 comprises an increasing depth around the circumference of the dial valve 18, the portion of the groove 28 in direct contact with the lower passage 30 is deeper than the portion of the grove 28 making contact with the upper passage 32. FIG. 8C shows the dial valve 18 in a substantially "open" position with the groove 28 making maximum contact with both the lower passage 30 and the upper passage 32. Having the groove 28 orientated as seen in FIG. 8C within the nozzle 10 creates a maximum volume in the passages 30, 32 thereby creating a minimum pressure allowing the outgoing fluid to expand and create the largest diameter conical spray possible. By manipulating the dial valve 28 such as for example into the position seen in FIG. 8B, a user changes the internal volume of the passages and thus increases the pressure of the outgoing fluid, creating a tighter, more compact conical spray as discussed above.

As also seen in FIGS. 8A-8C, the nozzle 10 further comprises a detachable orifice passage 34. The orifice passage 34 couples to the orifice 16 as is known in the art by a friction fit or snap fit. The orifice passage 34 effectively extends the length of the upper passage 32 and provides further surface area to focus, collimate, or otherwise alter the outgoing spray of fluid exiting the nozzle 10.

In addition to the dial valve 18 shown, other means for varying the internal pressure of the nozzle 10 not seen here may also be used. For example push buttons, needle valves, or internal passages of varying dimensions may also be used without departing from the original spirit and scope of the invention.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A nozzle having a pathway defined therein for varying the size of a spray pattern for use with an aerosol canister containing a fluid comprising:

a coupling portion of the pathway communicating with the aerosol canister;

an internal pathway communicating with the coupling portion of the pathway;

an orifice communicating with the internal pathway; and a dial valve communicating with the internal pathway which varies an internal pressure of a fluid within the internal pathway, wherein the dial valve is disposed at a junction of a lower passage and an upper passage defining the internal pathway and comprises a groove defined around the circumference of a distal end of the dial valve, wherein the depth of the groove increases as a function of its relative location around the circumference of the distal end of the dial valve, wherein the dial valve comprises a knob that is disposed on a proximal end of the dial valve and wherein the knob is disposed horizontally adjacent to an upper housing portion of the nozzle, wherein the groove is orientated towards both the lower passage and the upper passage of the internal pathway so that when the dial valve is actuated, the groove alters the size of a junction between the lower passage and the dial valve and the size of a junction between the upper passage and the dial valve simultaneously, and wherein the lower passage of the internal pathway is disposed off-center and perpendicular with respect to a central axis of the dial valve.

2. The nozzle of claim 1 where the groove defined in the dial valve is in fluidic contact with the lower passage and the upper passage of the internal pathway.

3. The nozzle of claim 1 wherein the dial valve comprises a body disposed between the knob and the groove.

4. The nozzle of claim 1 where the dial valve has a top and a bottom and the groove is configured to direct the flow of the fluid within the aerosol canister around the dial valve.

5. The nozzle of claim 1 where the lower passage and the upper passage defining the internal pathway are oriented obliquely with respect to each other.

6. A method for varying the size of a spray pattern created by a spray nozzle comprising:

coupling the nozzle to a pressurized canister containing a fluid;

flowing a fluid through a plurality of internal passages defined in the nozzle;

varying an internal pressure within at least two of the plurality of internal passages; and discharging the fluid from an orifice coupled to the at least two of the plurality of internal passages, wherein varying an internal pressure within the at least two of the plurality of internal passages comprises rotating a dial valve disposed at a junction of a lower passage and an upper passage defining the internal passages, wherein the dial valve has a distal end surface and comprises a groove with a continuously varying depth defined circumferentially into the distal end surface of the dial valve, and wherein the groove is orientated towards both the lower passage and the upper passage of the internal passages so that when the dial valve is actuated, the groove alters the size of a junction between the lower passage and the dial valve and the size of a junction between the upper passage and the dial valve simultaneously, and wherein rotating the dial valve comprises rotating a knob disposed on a proximal end of the dial valve, the knob being disposed horizontally adjacent to an upper housing portion of the nozzle.

7. The method of claim 6 wherein the groove comprises at least a shallow portion and a deep portion of the groove.

8. The method of claim 7 where the dial valve has a top and a bottom and flowing a fluid through a plurality of internal passages defined in the nozzle comprises orientating the groove defined in the dial valve to direct the flow of the fluid around the dial valve.

9. The method of claim 7 where varying an internal pressure within at least two of the plurality of internal passages comprises increasing the internal pressure within at least one of the two of the plurality of internal passages by rotating the dial valve and exposing the shallow portion of the groove to the flow of fluid.

10. The method of claim 7 where varying an internal pressure within at least two of the plurality of internal passages comprises decreasing the internal pressure within at least one of the two of the plurality of internal passages by rotating the dial valve and exposing the deep portion of the groove to the flow of fluid.

11. The method of claim 6 further comprising closing the flow of fluid through the plurality of internal passages defined in the nozzle.

* * * * *